US005544625A

United States Patent [19]

Rivern

[11] Patent Number: 5,544,625

[45] Date of Patent: Aug. 13, 1996

[54] FLUE BAFFLE FOR GAS-FIRED HOT WATER TANKS

[75] Inventor: Louis Rivern, Epiphanie, Canada

[73] Assignee: Giant Factories Inc., Montreal, Canada

[21] Appl. No.: 492,512

[22] Filed: Jun. 20, 1995

[51] Int. Cl.[6] ..... F22B 7/00

[52] U.S. Cl. ..... 122/155.2; 122/13.1; 122/44.2; 122/17

[58] Field of Search ..... 122/13.1, 17, 19, 122/44.2, 152.2

[56] References Cited

U.S. PATENT DOCUMENTS

| | | | |
|---|---|---|---|
| 953,958 | 4/1910 | Kelly | 122/17 |
| 1,859,745 | 5/1932 | Morley | 122/17 |
| 4,742,800 | 5/1988 | Eising | 122/17 |
| 4,953,510 | 9/1990 | Akkala et al. | 122/17 |

*Primary Examiner*—Noah P. Kamen

*Attorney, Agent, or Firm*—Swabey Ogilvy Renault; Guy J. Houle

[57] ABSTRACT

A flue baffle for use in a hot water tank flue through which flue gases from a burner chamber are discharged. The baffle is comprised of an elongated flat undulated metal strip having a securable flat upper end. The undulated metal strip is shaped to define a plurality of integrally formed, wave-shaped, deformations on opposed side portions of a central longitudinal axis thereof. A narrower undulated metal band is secured to the metal strip on opposed sides thereof and disposed substantially midway between the wave-shaped deformations on opposed sides of the flat metal strip. The upper end of the strip is adapted to retain the flue baffle axially within the flue to create turbulence and resistance to hot flue gases rising from the burner chamber to enhance heat exchange between the flue and a liquid being heated and in direct contact with an exterior surface of the flue.

9 Claims, 2 Drawing Sheets

FLUE BAFFLE FOR GAS-FIRED HOT WATER TANKS

TECHNICAL FIELD

The present invention relates to a flue baffle for use in a hot water tank flue through which flue gases from a burner chamber are discharged whereby to create turbulence and resistance of these gases to enhance heat exchange between the flue and liquid being heated and in direct contact with an exterior surface of the flue.

BACKGROUND ART

It is common with gas-operated water heaters to dispose the flue centrally, or sometimes offset from the central axis of the water tank so that the hot gases from the lower burner chamber are cooled as they rise up the flue or chimney which is in contact with the water being heated. In order to enhance this heat exchange between the exhaust flue gas and the water within the tank, baffles have been secured in the exhaust flue. An early patent teaching such method is U.S. Pat. No. 953,958 issued in 1910 wherein a chain and a plurality of discs are suspended within the flue to retard the rising gases so that the side wall of the flue absorbs heat and exchanges it with the liquid disposed thereabout. Since then a great number of baffle structures have been constructed and a popular one is to use a twisted spiral metal strip suspended or otherwise disposed within the flue. Examples of these are numerous and can be seen such as in U.S. Pat. Nos. 4,742,800, 4,953,510 and 1,859,745.

It is also customary with these flues to install dampers in an upper end thereof outside the water heaters whereby to maintain heat retention within the flue to cause the heat therein to further dissipate within the water if the temperature thereof is higher than that of the water. Also, when the flue cools down, a reverse effect occurs wherein the hot water then loses heat through the flue. Thus, the reason for the damper.

A disadvantage of known flue baffles is that they are complex in construction and with many of these it is necessary to weld numerous metal tabs onto a cold rolled steel twisted strip. Various errors do occur in that often not enough tabs are welded on the strip or too may tabs are welded. If there is not enough tabs, it affects the performance of the flue baffle and if there are too many this could cause a very dangerous condition by offering too much resistance. Such baffles, including the ones disclosed in U.S. Pat. Nos. 1,859,745 and 4,953,510 can be costly to produce.

SUMMARY OF INVENTION

It is therefore a feature of the present invention to provide a flue baffle for use in the flue of a gas-fired hot water tank and which substantially overcomes the above-mentioned disadvantages of the prior art.

According to the above feature, from a broad aspect, there is provided a flue baffle for use in a hot water tank flue through which flue gases from a burner chamber are discharged. The baffle is comprised of an elongated flat undulated metal strip having a securable flat upper end. The undulated metal strip is shaped to define a plurality of integrally formed, wave-shaped, deformations on opposed side portions of a central longitudinal axis thereof. A narrower undulated metal band is secured to the metal strip on opposed sides thereof and disposed substantially midway between the wave-shaped deformations on opposed sides of the flat metal strip. The upper end of the strip is adapted to retain the flue baffle axially within the flue to create turbulence and resistance to hot flue gases rising from the burner chamber to enhance heat exchange between the flue and a liquid being heated and in direct contact with an exterior surface of the flue.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
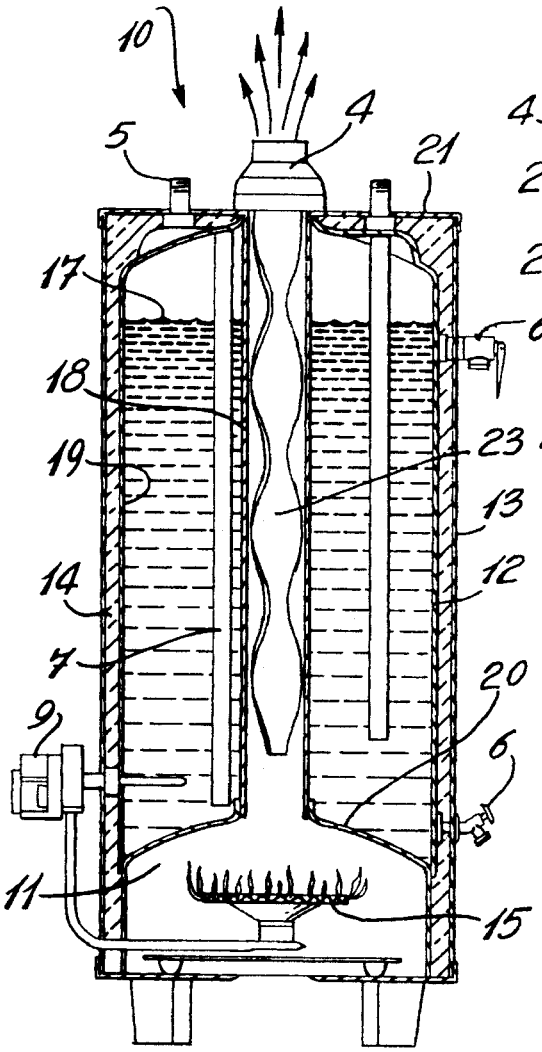
FIG. 1 is a simplified fragmented section view of a hot water tank having the flue baffle of the present invention secured in the exhaust flue thereof.

Referring now to the drawings, and more particularly to FIG. 1, there is shown generally at 10 a hot water heater of the type provided with a gas burner chamber 11 located in the base of an inner tank housing 12. The inner tank housing 12 is concealed within an outer shell 13 spaced therefrom a and between which is disposed a thermally insulating material 14. A burner and pilot 15 is disposed at the bottom of the tank and discharges a hot flame 16 within the burner chamber 11 to heat water 17 contained within the inner tank housing 12. A control 9 controls the burner 15. An exhaust flue 18 is disposed centrally of a water chamber 19 and extends from a bottom wall 20 thereof to the outside top wall 21 of the shell and a venting hood 4 caps the top of the flue 18. The flue baffle 23 of the present invention is suspended or otherwise secured within the flue 18. A pair of modes 7 are disposed within the chamber 19. A drain valve 6 is connected to the water tank 12 as well as a T&P valve 6. Hot water exits through the outlet nipple 5 usually containing a heat trap (not shown).

Figure 2:
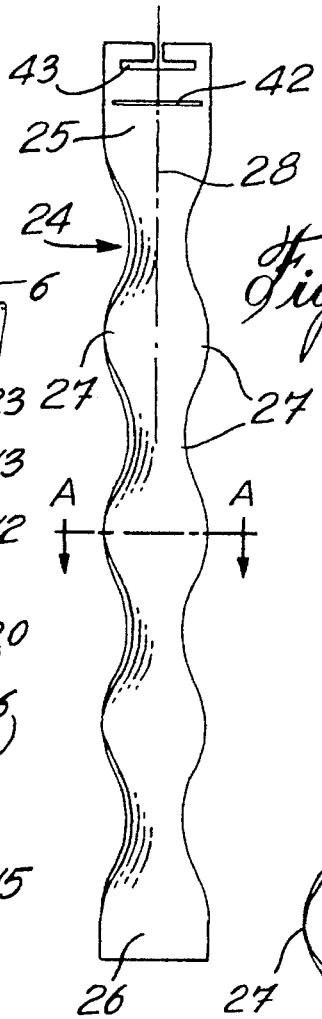
FIG. 2 is a plan view of the undulated metal strip constituting part of the flue baffle.
Figure 3:
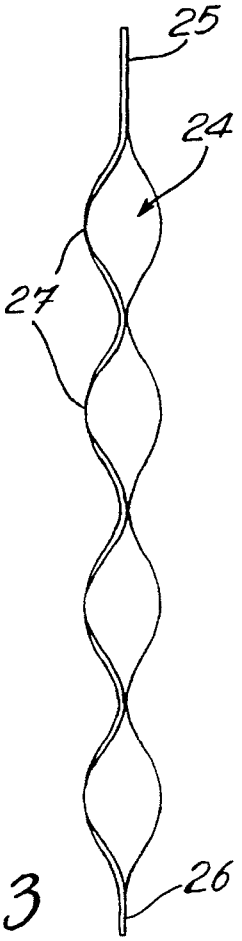
FIG. 3 is a side view of FIG. 2.
Figure 4:
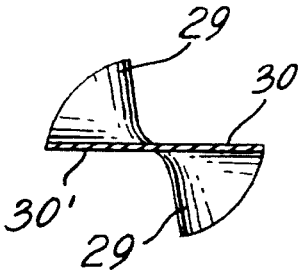
FIG. 4 is a section view along section lines A—A of FIG. 2.

Referring now to FIGS. 2 to 8, there will be described the construction of the flue baffle 23 of the present invention. As shown in FIGS. 2 and 3, the flue baffle is constructed from flat metal strips, herein cut and stamped from a 20 gauge sheet metal. The elongated metal strip 24 is shaped as a flat undulated metal strip having a securable upper end 25 and a straight lower end 26. A plurality of wave-shaped formations 27 are integrally formed on opposed side portions of a central longitudinal axis 28 of the metal strip 24. More specifically the wave-shaped formations 27 are formed in opposed side portions of the flat metal strip 24 and define spaced apart curve wall sections 29 extending on a respective side of opposed surfaces 30 and 30' of the flat metal plate, as better seen in FIG. 4.

With additional reference now to FIGS. 5 to 8, it can be seen that a narrow undulated metal band 31 is secured to the metal strip on opposed sides of the metal strip, i.e., to opposed surfaces 30 and 30' of the metal strip and extend substantially midway between the wave-shaped deformations 29 on opposed sides or opposed surfaces 30 and 30' of the flat metal strip. The undulated metal band 29 defines successive alternating V-shaped formations disposed alternately between the curved wall sections 29 on opposed sides of the longitudinal axis 28. The V-shaped formations 32 define an outer side wall 33 on a peak side 33 thereof and an inner side wall 35 on a trough side 36 thereof and in alternating sequence.

Figure 7:
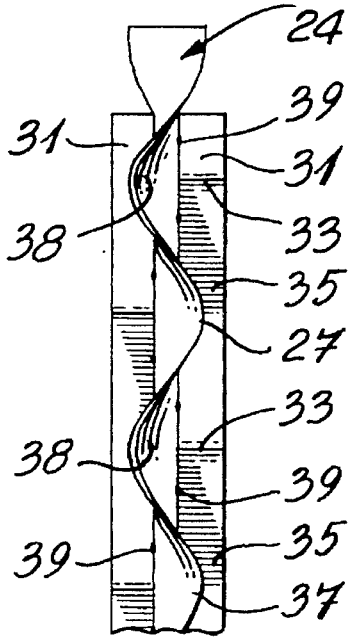
FIG. 7 is a further side view of part of the flue baffle shown in FIGS. 5 and 6 but viewed from the sides of the undulated metal bands.

As can be better seen from FIG. 7, the wave-shaped deformations 27 define a wave crest 37 and an adjacent wave trough 38 consecutively along the length of the metal strip 24. The metal bands 31 are secured to the metal strips by spot welds 39 and aligned with the wave crest 37 lying adjacent and spaced from the band trough inner side walls 35. The wave troughs 38 are disposed or lie adjacent and spaced from the band peak outer side wall portion 33.

Figure 8:
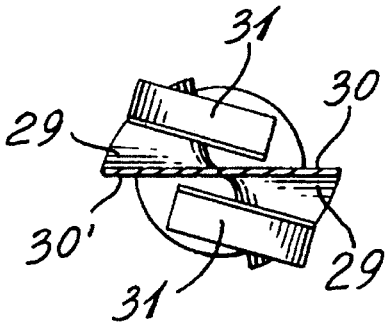
FIG. 8 is a section view along section lines B—B of FIG. 6.

When viewed in section, as shown in FIG. 8, there is provided a series of intertwined obstructing surfaces defining undulated pathways between the wave crests and wave troughs of the metal strips and the peaks and troughs of the metal band. This causes turbulence and limited resistance of the flue exhaust and exposes a great many surface areas of the strip and band to the exhausting hot flue gases thereby absorbing heat and causing the flue to provide excellent heat exchange with the water 17 thereabout and to be heated. After the burner is shut off, a damper provided in the damper chamber may be actuated and wherein the heat captive by the baffle continues to radiate through the flue and into the water or heat exchange within the flue 18 is retained by the baffle 23 to prevent excessive heat loss.

Figure 5:
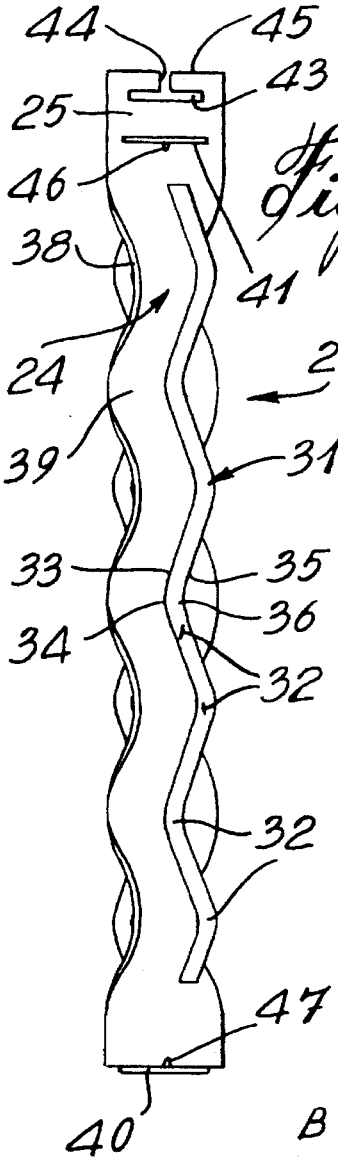
FIG. 5 is a plan view similar to FIG. 2 but showing an undulated metal band secured on opposed sides of the undulated metal strip and with a bottom and top disc secured transversely to the metal strip.
Figure 6:
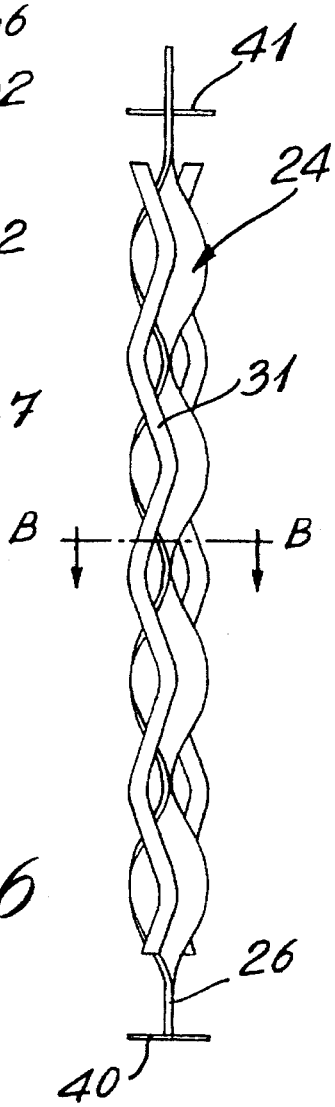
FIG. 6 is a side view of FIG. 5.

In order to prevent further heat loss, it can be seen, more clearly from FIGS. 5, 6 and 8 that a disc 40 is spot welded transversely in the straight lower end 26 of the metal strip 24. An upper disc 41 may also be secured transversely in a slot 42, as better shown in FIG. 2, which is provided spaced from an apertured slot 43 in the upper end 25 of the metal strip 24. The apertured slot 43 is provided with a restricted opening 44 in a top edge 45 of the strip for suspending the strip in the flue. As hereinshown, the discs 40 and 41 are circular discs having a diameter which is less than the width of the metal strip 24.

It is within the ambit of the present invention to cover any obvious modifications of the preferred embodiment described herein, provided such modifications fall within in the scope of the appended claims.

I claim:

1. A flue baffle for use in a hot water tank flue through which flue gases from a burner chamber are discharged, said baffle being comprised of an elongated flat undulated metal strip having a securable upper end, said undulated metal strip being shaped to define a plurality of integrally formed wave-shaped deformations on opposed side portions of a central longitudinal axis thereof, and a narrower undulated metal band secured to said metal strip on opposed sides thereof and disposed substantially mid-way between said wave-shaped deformations on opposed sides of said flat metal strip, said upper end being adapted to retain said flue baffle axially within said flue to create turbulence and resistance to hot flue gases rising from said burner chamber to enhance heat exchange between said flue and a liquid being heated and in direct contact with an exterior surface of said flue.

2. A flue baffle as claimed in claim 1 wherein said wave-shaped deformations are formed in opposed side portions of said flat metal strip and define spaced-apart curved wall sections extending on a respective side of opposed surfaces of said flat metal plate, said undulated metal band defining successive alternating V-shaped formations disposed alternately between said curved wall sections on opposed sides of said longitudinal axis, said V-shaped formations defining an outer side wall on a peak side thereof and an inner side wall on a trough side thereof in alternating sequence, said wave-shaped deformations also defining wave crests and wave troughs, said wave crests lying adjacent and spaced from said band trough inner side wall and said wave troughs lying adjacent and spaced from said band peak outer side wall.

3. A flue baffle as claimed in claim 2 where there is further provided a lower disc secured transversely to a straight lower end section of said elongated flat undulated metal strip, said disc being dimensioned not to exceed the width of said metal strip.

4. A flue baffle as claimed in claim 3 wherein there is further provided an upper disc secured transversely and spaced from said upper end of said metal strip, said upper disc being retained in a slot formed in an upper flat section of said metal strip.

5. A flue baffle as claimed in claim 4 wherein said upper and lower discs are circular thin metal discs.

6. A flue baffle as claimed in claim 1 wherein said upper end of said metal strip is provided with an apertured slot having a restricted opening in a top edge of said strip for suspending said strip in said flue.

7. A flue baffle as claimed in claim 6 wherein said flue is a flue pipe of circular cross-section.

8. A flue baffle as claimed in claim 1 wherein said metal band is secured to said metal strip by a plurality of spot welds.

9. A flue baffle as claimed in claim 1 wherein said metal strip and metal band are constructed from 20 gauge steel sheets.

* * * * *